United States Patent [19]

Zickar et al.

[11] 4,051,809

[45] Oct. 4, 1977

[54] APPARATUS FOR CLEANING AND COATING AN ELONGATED METALLIC MEMBER

[75] Inventors: Frank R. Zickar; Paul Voytik, both of Sharon, Pa.

[73] Assignee: Westinghouse Electric Corporation, Pittsburgh, Pa.

[21] Appl. No.: 725,215

[22] Filed: Sept. 22, 1976

[51] Int. Cl.[2] ..... B05B 5/02

[52] U.S. Cl. ..... 118/630; 118/40; 118/DIG. 5

[58] Field of Search ..... 118/DIG. 5, 404, 405, 118/429, 309, 420, 72, 73, 67, 630, 634; 427/185, 21

[56] References Cited

U.S. PATENT DOCUMENTS

| | | | |
|---|---|---|---|
| 3,396,699 | 8/1968 | Beebe et al. | 118/634 |
| 3,476,081 | 11/1969 | Facer et al. | 118/405 X |
| 3,566,833 | 3/1971 | Beebe et al. | 118/405 X |
| 3,916,826 | 11/1975 | Knudsen | 118/629 |

*Primary Examiner*—Ronald Feldbaum
*Attorney, Agent, or Firm*—D. R. Lackey

[57] ABSTRACT

Apparatus for continuously cleaning and electrostatically coating an elongated metallic member, which apparatus is especially suitable for uniformly coating copper and aluminum wire having a rectangular cross-sectional configuration. An electrically grounded, rectangular wire is continuously moved in a horizontal plane, while held under constant tension, through apparatus which chemically etches the wire, and which then provides a cloud of electrostatically charged, heat fusible particles about the clean wire. The charged particles are attracted to the grounded wire and the apparatus further includes baffles at predetermined strategic locations in the cloud which provide a uniform deposit of particles on all sides of the wire. The apparatus then heats the wire to a predetermined elevated temperature to melt the particles and cure the resulting film to provide a tenacious insulating coating on the wire.

17 Claims, 7 Drawing Figures

APPARATUS FOR CLEANING AND COATING AN ELONGATED METALLIC MEMBER

BACKGROUND OF THE INVENTION

1. Field of the Invention

The invention relates in general to apparatus for continuously coating an elongated metallic member, and more specifically to such apparatus which initially applies the coating to the conductor in dry powder form via electrostatic techniques.

2. Description of the Prior Art

Copper and aluminum wire have conventionally been coated in multiple-pass vertical coating towers using solvent base coating materials. The energy requirements in such a coating facility are quite high, and the solvent may present safety and pollution problems unless properly dealt with. The high energy costs and costly safety and anti-pollution apparatus for dealing with the solvent have made it economically attractive to consider alternate arrangements for applying an insulating coating on a continuously moving wire.

The electrostatic dry powder technique is particularly attractive, as solvents are not used, and a coating of the desired build or thickness may be applied to the wire in a single pass. The energy requirements are substantially lower, compared with using solvent base materials, only requiring that the wire be heated to the focusing and curing temperature of the particulated deposit on the wire.

If an existing solvent base coating facility is converted to an electrostatic wire coating facility, the wire is necessarily coated while moving vertically. The vertical orientation of the wire through a cloud of electrostatically charged particles promotes a uniform deposit on all sides of a rectangular wire, but it also presents certain problems. The line speed is limited by the cloud height, which has a certain practical limitation due to gravity. A horizontal facility does not have this limitation. A horizontal powder coating facility is felt to offer other advantages over a vertical facility, such as reduced scrap, easier operator control and maintenance, and better control of the coating build dimension. Also, a new horizontal powder coating facility may be installed for lower capital facility cost than a new vertical powder coating facility. The horizontal powder coating facility, however, presents certain problems in achieving build uniformity about the circumference of the wire, and the problem is compounded when the wire has a rectangular cross-sectional configuration.

U. S. Pat. No. 3,248,253 discloses a horizontal powder coating facility in which a grounded wire passes over a bed of electrostatically charged particles, which creates a cloud of particles above the bed due to the difference in the electrical potential between the charged particles and the grounded wire.

U. S. Pat. No. 3,396,699 discloses a horizontal powder coating facility which is directed to controlling the build dimension on the wire by adjustable barrier tubes which control the effective length of the cloud chamber, and a blower to dislodge non-electrostatically attracted particles from the wire.

U. S. Pat. No. 3,560,239 discloses a horizontal powder coating facility which includes applying and drying a primer coating to the wire prior to an electrostatically applied coating.

U. S. Pat. No. 3,566,833 discloses a horizontal powder coating facility which includes a spray gun in the coating chamber along with a fluidized bed of electrostatically charged particles.

U. S. Pat. No. 3,865,079 discloses a horizontal powder coating facility directed to an arrangement for electrostatically charging the powder.

U. S. Pat. No. 3,916,826 discloses a vertical powder coating facility directed to an arrangement for charging the powder.

Application Ser. Nos. 648,444 and 678,579, filed Jan. 12, 1976 and Apr. 20, 1976, respectively, which are assigned to the same assignee as the present application, disclose vertical powder coating facilities directed to arrangements for controlling the coating thickness, and for producing a more uniform coating on the wire, respectively.

SUMMARY OF THE INVENTION

Briefly, the present invention is new and improved electrostatic powder coating apparatus for continuously applying a tenacious coating of insulating material on horizontally disposed copper and aluminum wire.

The electrostatic coating apparatus includes a chamber having a gas permeable insulating member which forms the support for a bed of finely divided, heat fusible particles of insulating material. A gas permeable electrode is spaced below the insulating member, and a supply of dry air is successively passed through the electrode, insulating member, and bed of particles, to fluidize the bed, electrostatically charge the particles, and create a cloud of charged particles above the bed through which an electrically grounded wire to be coated is passed.

A uniform layer of particles is applied to rectangular wire, notwithstanding the horizontal orientation thereof, by a baffle arrangement in the cloud which includes a first baffle member disposed below the wire, between the wire and the fluidized bed of dry powder, and second and third baffle members disposed on opposite sides of the wire which are oriented to deflect the vertically rising cloud of electrostatically charged particles towards and over the upper surface of the wire.

The coating thickness or build is more easily controlled by disposing a foraminous gas diffuser member formed of an electrical insulating material in the space between the gas permeable electrode and the gas permeable insulating member, such that the vertically oriented ionized gas or air, as it leaves the electrode, strikes the diffuser member. The holes or openings through the diffuser member are selected such that about 10% of the ionized air passes through the openings while the remaining air is forced to flow in a longer path, around the outer edges of the diffuser member.

To successfully electrostatically powder coat copper or aluminum wire it must have an exceptionally clean surface. This is achieved according to the teachings of the invention by chemically etching the outer surface of the wire in apparatus which passes the wire through a chemical bath having an ultrasonic transducer therein for creating ultrasonic vibrations. The apparatus rinses the wire in a free flowing water rinse, and then follows the rinse with a hot water bath which also includes an ultrasonic transducer for creating ultrasonic vibrations in the bath.

When the rectangular wire has other than a square configuration, the wire is wound on supply reels with the wider dimension against the reel. In an alternate embodiment, the wire is advanced through apparatus which twists the wire 90 ° about its longitudinal axis, before entering the powder coating apparatus, such that the surfaces of the wire which are associated with the narrower cross-sectional dimension are horizontally disposed. The wire is then returned to its original orientation following the fusing of the coating into a tenacious solid insulating film, prior to rewinding the wire on a take-up reel.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
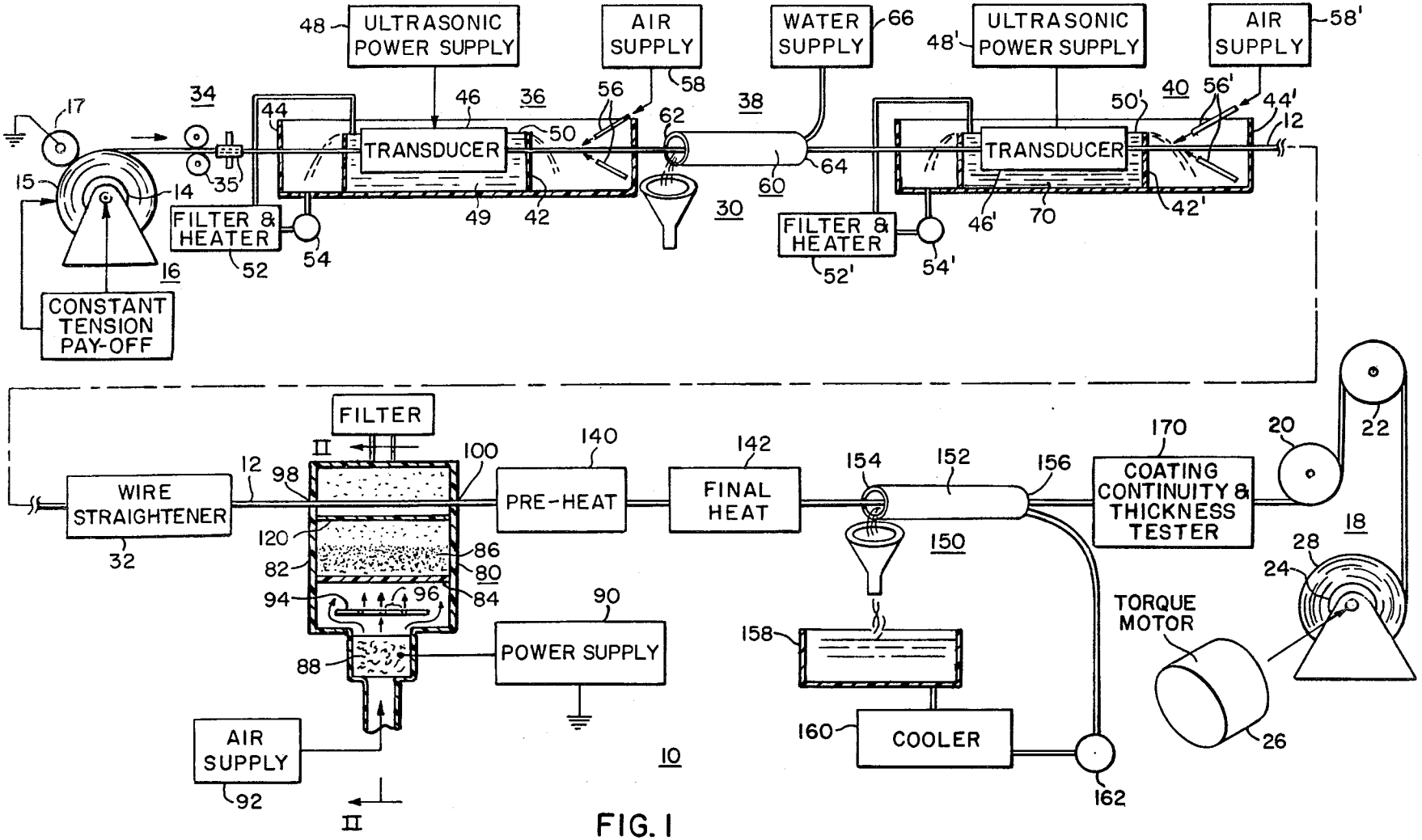
FIG. 1 is a diagrammatic view, in elevation, of horizontal electrostatic powder coating apparatus constructed according to the teachings of the invention.

Referring now to the drawings, and FIG. 1 in particular, there is shown horizontal electrostatic powder coating apparatus 10 constructed according to the teachings of the invention. Apparatus 10 is illustrated and described relative to a single elongated metallic member 12, but any practical number may be simultaneously coated. Further, the elongated metallic member 12 will be assumed to have a generally rectangular crosssectional configuration, i.e., a parallelogram having right angles, in which the base and height are equal, i.e., a square, or unequal. A rectangular configuration is assumed because the invention is particularly suitable to wire of such configuration, but certain aspects of the invention are also beneficial to the coating of round wire.

It is of critical importance to the success of an electrostatic powder coating facility, that the elongated metallic member 12 to be coated, hereinafter referred to as wire 12, maintain a constant height over the fluidized bed as it progresses through the cloud of electrostatically charged particles, with no vertical movement, whipping or jerking. The constant height assures that the coating on the wire will achieve the desired build dimension, and that the build dimension will not significantly change over the length of the wire. Jerking or snapping of the wire 12 must be eliminated, as it may dislodge the electrostatically attracted particles from the wire, resulting in an uneven coating and possibly voids in the insulating film.

The wire to be coated is wound on a reel or spool 14 to form a supply roll 15 which is mounted on pay-off means 16, with the wire usually being electrically grounded through the pay-off means, such as functionally illustrated at 17. The point where the wire is electrically grounded is not important, and it may be grounded at any other suitable location. The pay-off means 16 must be of the compensating type, to achieve the above-mentioned requirements. In other words, it must maintain a constant tension in the wire 12 as it is pulled from the supply reel 14, automatically compensating for the change in the diameter and the weight of the supply roll 15 as the wire 12 is paid out.

The wire 12 is pulled from the supply roll 15 by take-up means 18 which includes a suitable guide sheave 20 which directs the wire from a horizontal to a vertical orientation about a capstan 22 which sets the drive speed, and a spool or reel 24 driven by a spool drive 26, such as a torque motor. A level winding guide (not shown) traverses the spool 24 as the wire 12 is wound thereon, to guide the wire back and forth and provide uniformly spaced turns on the resulting roll 28 and prevent damage to the insulating coating.

The wire 12 is cleaned and straightened, in either order, prior to entering the electrostatic coating chamber. As illustrated in FIG. 1 the wire 12 enters cleaning apparatus 30 prior to entering a wire straightener 32, as the wire straightener 32 provides a good support for the wire 12 just prior to its entering the electrostatic coating apparatus. Once the wire 12 enters the coating apparatus, it cannot be mechanically contacted again until the particles of insulation attracted to the wire have been fused by heat and solidified into a solid insulating film.

The cleaning apparatus 30 may include means 34 for mechanically abrading the wire surface to remove burrs which exceed the desired coating thickness. As illustrated, spring or weight loaded or biased wheels 35 of a suitable abrasive material may be driven in a circumferential direction opposite to the direction in which they would be rotated by movement of the wire 12.

The cleaning apparatus 30 additionally includes an ultrasonic chemical cleaning apparatus 36, free flowing water rinse apparatus 38, and ultrasonic hot water rinse apparatus 40.

Ultrasonic hot water cleaning apparatus was tried, but it failed to adequately remove rolling lubricants from the wire, at least to the degree necessary to assure a tenacious coating of insulating material which would not peel or crack when the insulated wire is wound into a coil, such as a coil for a transformer winding. It was found that ultrasonic chemical cleaning apparatus, followed by ultrasonic hot water cleaning apparatus, provided a wire surface which was very suitable for electrostatic powder coating. Ultrasonic chemical cleaning is highly effective in removing loose slivers, fines, and other metallic debris, loosened by the abrasion apparatus 34, and in addition it removes rolling lubricants and chemically etches the surface of the wire. The chemically etched surface promotes maximum adhesive forces between the powder coating and the wire. The free running water rinse and the ultrasonic hot water rinse remove all trace of the chemical before the wire enters the electrostatic coating apparatus.

More specifically, the ultrasonic chemical cleaning apparatus may include a first tank 42 mounted within a second tank 44. The first tank 42 includes an ultrasonic transducer 46 mounted therein and connected to a suitable ultrasonic power supply 48. A liquid chemical solution 49 is maintained at a predetermined level 50 in the first tank 42, notwithstanding inlet and outlet openings in the tank for movement of the wire 12 therethrough, by pumping the chemical solution into the tank 42 at a rate which exceeds the rate of liquid leakage through the inlet and outlet openings. The leakage and overflow from tank 42 enters a drain in the second tank 44 and it is pumped through a filter 52 via a pump 54, back into the first tank 42. As illustrated generally in block 52, which represents the filter, a heater may also be provided to maintain the chemical solution at the desired temperature, if the chemical used is more effective at an elevated temperature.

When the wire 12 to be coated is formed of aluminum, a caustic chemical solution having a pH of 12 to 14, such as Oakite 160, which solution is maintained at a temperature of 160° ± 5° F has been found to be highly effective. If the wire is formed of copper, an acid at room temperature, such as Oakite 34M has been found to be suitable.

Air jets 56, connected to a compressed air supply 58, are directed at the surface of the wire 12 as it leaves the tank 42 to remove as much of the chemical solution from the wire as possible before the wire leaves the tank 44.

The free flowing water rinse apparatus 38 is used to remove the remaining chemicals on the wire which are susceptible to removal by water at room temperature. It prevents contamination of the ultrasonic hot water rinse apparatus 40. The free flowing water rinse apparatus 38 includes a tubular member 60 having an opening which extends between first and second ends 62 and 64, respectively. The opening is large enough to accommodate the largest wire to be coated, with the tubular member 60 being mounted with its longitudinal axis coincident with the longitudinal axis of the wire 12. Water from a water supply 66 is directed into the second end 64 of the tubular member with sufficient force that it flows through the tubular member and exits the first end 62. It may then be collected in a suitable receptacle for proper treatment. The tubular member 60 enables an effective rinse to be obtained while using water at a relatively low rate. For example, only 6 gallons per minute are required, regardless of the line speed. The tubular member also insures that the portion of the wire leaving the second end 64 is in contact with clean water.

The ultrasonic hot water rinse apparatus 40 is similar to the ultrasonic chemical cleaning apparatus 36, with like apparatus being identified with the same reference numerals, except for the addition of a prime mark. The essential difference is that instead of the tank 42' being filled with a chemical solution, it is filled with water 70, which is recirculated via a pump 54' through a filter and heater 52'. The heater maintains the water at a temperature of 160° ± 5°. The ultrasonic hot water rinse removes any final traces of chemical from the wire and it provides a clean surface ideal for receiving the electrostatically applied powder and for bonding the particles to the wire when they are heat fused.

The air jets 56' are used to dry the wire 12, and they may be connected to a hot air supply, if desired, to accelerate the drying process as well as to maintain the elevated wire temperature resulting from the hot water in the tank 42'. If the elevated wire temperature is maintained, it reduces pre-heat requirements prior to the final heat cure operation. It is important that the wire temperature be below the softening or melting point of the powder as it enters the electrostatic coater, in order to accurately control the coating thickness, and enable very thin coatings, such as 1 to 2 mils to be obtained, when such thin coatings are desired.

If the wire 12 was not straightened prior to the cleaning process, it is now straightened, indicated generally at 32. The wire straightening apparatus 32 may be conventional. The location of the wire straightener 32 just prior to the wire's entering the electrostatic apparatus is beneficial from the standpoint of guiding the wire, as it provides an excellent support for maintaining the desired positional relationship of the wire 12 in the electrostatic coating apparatus.

Figure 2:
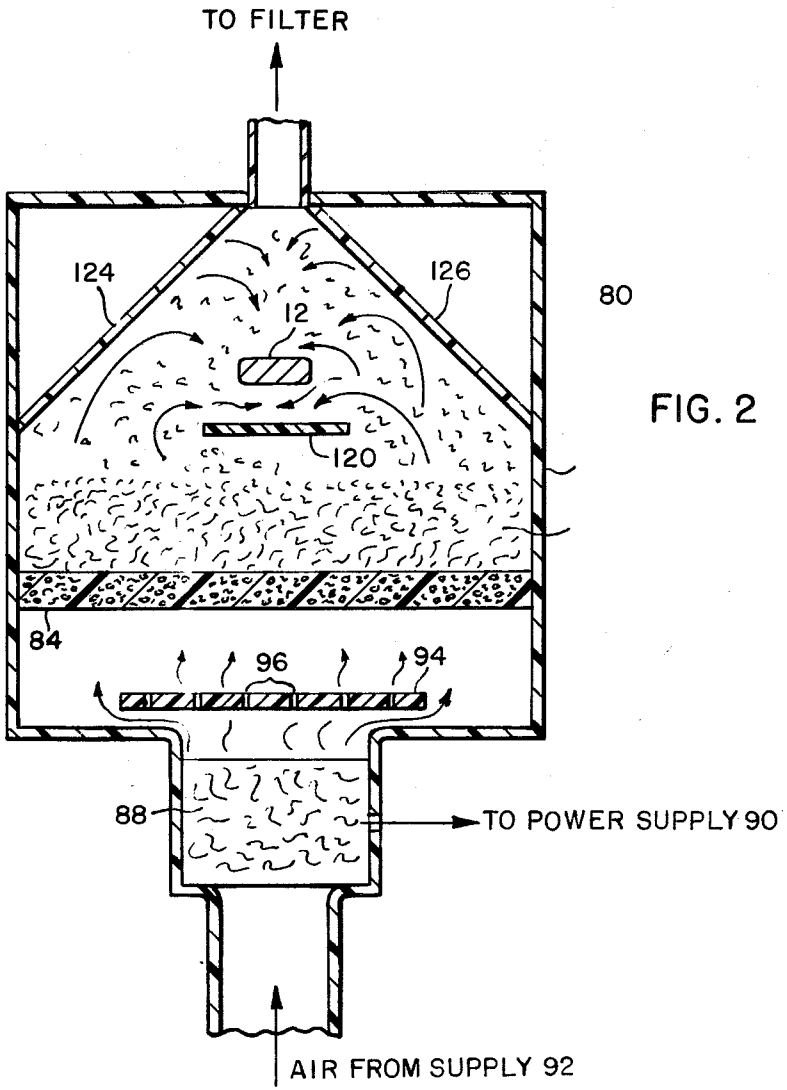
FIG. 2 is a sectional view, in elevation, of an electrostatic powder coating chamber shown in FIG. 1, taken between and in the direction of arrows II—II.

The wire 12 is now ready for electrostatic deposition of insulating particles thereon, which step is performed by electrostatic coating apparatus 80. FIG. 2, which is an elevational view, in section, of the coating apparatus 80 shown in FIG. 1, taken between and in the direction of arrows II—II, will also be referred to when describing apparatus 80. The powder may be fluidized and electrically charged in a manner similar to that shown in the hereinbefore mentioned U.S. Pat. No. 3,916,826. The coating apparatus 80 includes a chamber 82 having a horizontally oriented porous or otherwise gas permeable support member 84 disposed therein. A bed 86 of heat fusible, particulated electrical insulating material, such as the epoxy powder formulation disclosed in co-pending application Ser. No. 661,070, filed Feb. 25, 1976, which is assigned to the same assignee as the present application, is disposed on the support member 84. A suitable level control (not shown) senses the bed height and operates a motorized hopper supply of the powder, to maintain the desired level.

The bed of powder is fluidized and electrostatically charged by a stream of ionized gas which flows upwardly through the porous support member 84. The ionized gas stream is provided by a gas permeable electrode structure 88, such as metallic wool, brushes, and the like, spaced below the support member 84. The electrode structure 88 is connected to a high voltage power supply 90. The power supply 90 provides an adjustable DC voltage in the range of about 30 KV to 80 KV. A supply 92 of dry air is directed upwardly through the electrode structure 88, resulting in a highly ionized stream of gas leaving the electrode structure.

A foraminous diffuser member 94 formed of a suitable electrical insulating material, is disposed in the stream of ionized gas, between the electrode structure 88 and the support member 84. The diffuser member 94, as illustrated most clearly in FIG. 2, includes first and second, horizontally oriented, major opposed surfaces 95 and 97, respectively, with a plurality of vertically oriented openings 96 extending between the surfaces 95 and 97. A preferred location for the diffuser member 94 is about 1 inch (25 mm) above the upper surface of the electrode structure 88. The diffuser member 94 lengthens the normally vertically oriented gas flow path, and the openings 96 through the diffuser member 94 permit a predetermined percentage of the ionized gas stream to follow the shorter direct path, rather than the extended flow path. The openings 96 in the diffuser member 94 enable the power supply voltage to be reduced for a given line speed and coating thickness, compared to using a solid diffuser plate. Thus, instead of operating at maximum supply voltage, the voltage may be reduced to provide a voltage control range which enables the coating thickness to be selected by merely selecting a voltage level, without changing the line speed. The foraminous diffuser member 94 may be constructed by forming a plurality of 1/32 inch holes 96 in a solid insulating member to allow about 10% of the air to flow through the diffuser member. The number of openings and the diameter(s) thereof are selected to achieve the desired ratio of air which passes through the diffuser member to the air which is forced to flow about its other edges.

The rate of flow of the ionized gas stream is controlled to fluidize the bed 86 and provide a cloud of electrostatically charged particles above the bed. The chamber 82 includes suitable inlet and outlet apertures or openings 98 and 100, respectively, through which the wire 12 passes, with the openings being oriented to enable the wire to pass horizontally through the cloud of electrostatically charged particles.

Figure 2A:
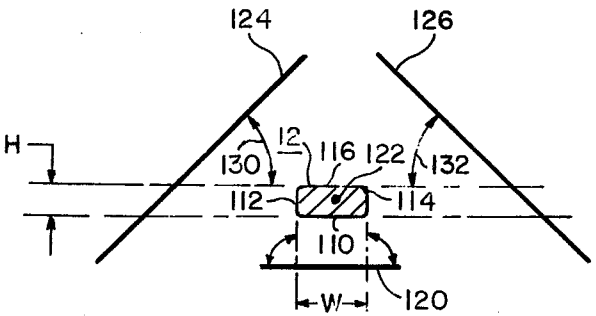
FIG. 2A is schematically illustrates predetermined relationships between the wire and the baffle members shown in FIG. 2.

Round wire may be uniformly coated by the electrostatic coating apparatus 80 described up to this point. Coating wire having a generally rectangular configuration, however, results in a greater build dimension on the lower surface of the wire 12, i.e., the surface which faces the bed 86, than on the opposite or upper surface of the wire. The present invention solves the nonuniformity problem by a plurality of baffle members, which are shown more clearly in FIG. 2. As hereinbefore mentioned, FIG. 2 is an elevational view, in section, of the coating apparatus 80, shown in FIG. 1. FIG. 2A will also be referred to, which is a schematic representation of the wire 12 and baffle arrangement.

More specifically, wire 12 has a rectangular cross-sectional configuration, with a first planar surface 110 horizontally disposed to face the bed 86, second and third planar surfaces 112 and 114 which extend vertically upward from the first planar surface, and a fourth planar surface 116, which is parallel to the first planar surface 110. The width W of the first planar surface is the base of the rectangular configuration, and the width of the second and third planar surfaces is the height H of the rectangular configuration. The width W and height H may be different dimensions, or they may be equal to one another.

The baffle arrangement includes a first baffle member 120 spaced below the wire 12, between the first planar surface 110 and the bed 86 of powder. The first baffle member 120 is symmetrically disposed relative to the longitudinal axis 122 of the wire 12, and it is important that the width dimension of the baffle exceed the width W of the first planar surface 110 which faces the first baffle member. The width dimension of the first baffle member 120 is preferably in the range of 1 to 3 inches (25 to 75 mm).

The baffle arrangement additionally includes second and third baffle members 124 and 126 disposed adjacent to but spaced from the second and third planar surfaces 112 and 114 of the wire 12. The second and third baffle members 124 and 126 include surfaces which are oriented to deflect the upwardly moving stream of electrostatically charged particles in the cloud towards and over the top of the wire, i.e., over the fourth planar surface 116. As illustrated in FIG. 2A, extensions of the first and fourth planar surfaces intersect the second and third baffle members, forming acute angles above such intersections, such as acute angles 130 and 132 formed between extensions of the fourth planar surface 116 and the second and third baffle members. The baffle members 124 and 126 are preferably oriented to provide acute angles 130 and 132 in the range of about 30° to 45°.

The wire 12 with the electrostatically applied particles thereon is then heated to fuse the particles and provide a uniform tenacious film of insulation on the wire. The apparatus for heating the wire preferably includes means 140 for preheating the wire to a temperature above the softening point of the particles, and means 142 for heating the wire to the desired heat fusing and curing temperature. The pre-heat 140 is selected to heat the wire without air movement, as the electrically attracted insulating particles must not be disturbed. An induction pre-heat or an oven pre-heat, such as an oven with infrared heaters, is suitable. The pre-heat means 140 preferably heats the wire to a temperature of about 125° C. A pre-heat, before the wire enters the more elevated temperature of the final heating step has been found to reduce the chance of air being trapped in the coating.

The means 142 for providing the final heating step, fuses and cures the particles to form a thin insulating film. Means 142, which is also selected to heat the wire 12 without air movemement, may be an infrared oven. Means 142 heats the wire to a temperature dependent upon the length of time that the wire is in the heating means. In order to reduce the length of the heating means or oven and still permit the desired line operating speed, the oven preferably heats the wire to the upper end of the temperature range for the particular powder utilized. For the epoxy formulation disclosed in the hereinbefore mentioned co-pending application, a temperature of about 500° C is suitable.

The wire 12 is then quenched or cooled by cooling apparatus 150, to permit respooling and handling thereof, with the cooling apparatus 150 preferably including a tubular member 152 having an opening which extends between first and second ends 154 and 156, respectively. The wire enters the first end 154 and the water is introduced into the second end 156 and directed towards the first end. This arrangement prevents shocking the hot insulating coating on the wire, as the hottest water will be at the entrance end of the tubular member 152. The water may be collected in a suitable reservoir 158, cooled to a predetermined temperature by suitable cooling means 160, and pumped via a pump 162 to the second end 156 of the tubular member 152.

Suitable testing means 170 may then be provided, such as for testing the coating for continuity, and checking the coating to assure that it is within the desired thickness range. The testers may be conventional. After the wire is checked, it is ready for respooling on the take-up means 18.

It has been found that when rectangular wire is coated in which one dimension of the wire is substantially greater than the other, that the wire may be more uniformly coated on all sides by changing the orientation of the wire before it enters the electrostatic coating apparatus 80, to cause its smaller dimension to face the fluidized bed of particles. This embodiment of the invention is illustrated in FIG. 3.

More specifically, as the wire 12 leaves the supply spool 14, it is passed through suitable roller means 180 which twists the wire 90° about its longitudinal axis. FIG. 4 is a cross-sectional view of the wire 12 as it appears just before entering the twist rollers 180, taken between arrows IV—IV of FIG. 3. Wire 12 has a width dimension W which is substantially greater than its height dimension H. It is wound on the supply spool 14 with its wider dimension W disposed against the spool surface because of ease of winding such rectangular conductor.

Figure 3:
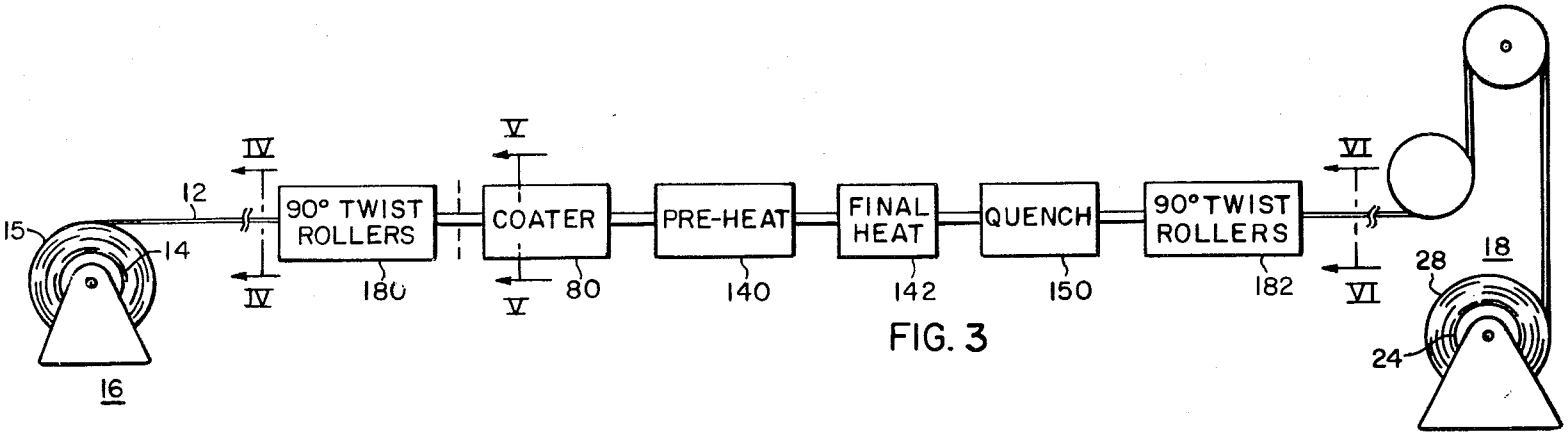
FIG. 3 is a diagrammatic view, in elevation, of horizontal electrostatic powder coating apparatus constructed according to another embodiment of the invention.
Figure 6:
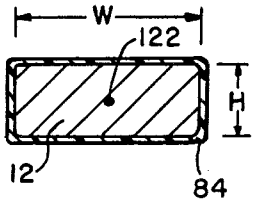
FIGS. 4, 5 and 6 are cross-sectional views of the wire shown in FIG. 3, taken between arrows IV—IV, V—V, and VI—VI, respectively.
Figure 5:
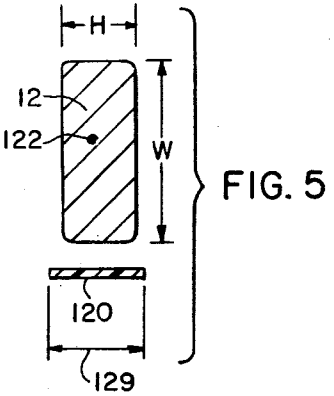
Figure 4:
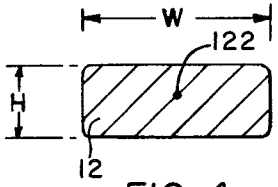

FIG. 5 is a cross-sectional view of the wire 12 as it appears on the output side of the twist rollers 180, with the view in FIG. 5 being taken through the coater 80, between arrows V—V of FIG. 3. The height dimension H now faces the fluidized bed 86. The baffle arrangement shown in FIGS. 2 and 2A may also be used in this embodiment. However, it has been found that when the dimension H is substantially smaller than the dimension W, that satisfactory uniform coatings may be achieved using only the first baffle member 120. As illustrated in FIG. 5, the width 129 of the first baffle member 120 exceeds the dimension H. The wire 12 is coated, heated and quenched by the means described relative to FIG. 1, and prior to being respooled by take-up means 18 it is twisted back to its original orientation via 90° twist rollers 182. FIG. 6 illustrates the orientation of the wire 12 after it leaves the rollers 182, with FIG. 6 being a cross-sectional view of the wire taken between arrows VI—VI shown in FIG. 3. FIG. 6 also illustrates an insulating coating 184 disposed uniformly about the outer surface of the wire 12.

In summary, there has been disclosed new and improved apparatus for applying an insulating coating to wire, which is especially suitable for wire having a rectangular cross-sectional configuration. The disclosed apparatus may apply an insulating film of 1 to 2 mils, or greater, to a continuously moving wire in a horizontal plane, utilizing a single pass, and it may be used to uniformly apply various thin films, such as 1 or 2 mils, to such rectangular wire. The disclosed apparatus will provide a tenacious insulating film on aluminum or copper wire, which wire may subsequently be wound into electrical coils without peeling or cracking of the coating.

We claim as out invention:

1. Apparatus for applying an insulating coating or an elongated, continuously moving, metallic member having first, second, third and fourth planar surfaces which define a substantially rectangular cross-sectional configuration, comprising:

a coating chamber, a bed of finely divided, heat fusible particles of electrical insulating material in said coating chamber, means providing a cloud of electrostatically charged particles above said bed, means moving the metallic member through said cloud of particles, with the first planar surface horizontally oriented above said bed, said second and third planar surfaces extending vertically upward from opposite sides of the first planar surface, and said fourth planar surface parallel to the first planar surface, means electrically grounding the metallic member to cause said charged particles to adhere to the metallic member as it passes through said cloud, baffle means disposed in said chamber to provide a substantially uniform deposit of particles on the planar surfaces of the metallic member, said baffle means including a first baffle member disposed between the bed of particles and the first planar surface of the metallic member, with said first baffle member having a width dimension which exceeds the width of the first planar surface, and second and third baffle members spaced from the vertically extending second and third planar surfaces, respectively, said second and third baffle members each having first surfaces dimensioned and oriented such that extensions of the first and fourth planar surfaces of the metallic member intersect these first surfaces, providing acute angles above the intersecting extended planes and first surfaces of the second and third baffle members, and means fusing the particles deposited on the metallic member to provide a substantially uniform insulating coating on the metallic member.

2. The apparatus of claim 1 wherein the first surfaces of the second and third baffle members are oriented to provide acute angles with a horizontally disposed intersecting plane in the range of about 30° to 60°.

3. The apparatus of claim 1 including a supply reel for the metallic member and including means for twisting the metallic member 90° about its longitudinal axis such that the orientation of the conductor through the coating chamber and fusing means is in 90° rotational symmetry with the orientation of the metallic member as it leaves the supply reel.

4. Apparatus for applying an insulating coating on an elongated, continuously moving, metallic member having planar surfaces which define a substantially rectangular cross-sectional configuration in which the width dimension exceeds the height dimension, comprising:

a coating chamber, a bed of finely divided, heat fusible particles of electrical insulating material in said coating chamber, means providing a cloud of electrostatically charged particles above said bed, means for moving the metallic member through said cloud of particles, with the planar surfaces which define the narrower height dimension being oriented parallel with the surface of the bed of particles, means for electrically grounding the metallic member to cause said charged particles to deposit on the metallic member as it passes through said cloud, at least one baffle member in said coating chamber between the bed of particles and the metallic member, said at least one baffle member having a width dimension transverse to the movement direction of the metallic member which exceeds the dimension of the metallic member which is oriented parallel with the surface of the bed of particles, and means fusing the particles deposited on the metallic member to provide a film of insulating material thereon.

5. The apparatus of claim 4 including a supply reel upon which the metallic member is wound, with the planar surfaces which define the wider dimension being parallel to the rotational axis of the supply reel, and including means disposed between the supply reel and the coating chamber for twisting the metallic member 90° about its longitudinal axis.

6. The apparatus of claim 5 including a take-up reel upon which the metallic member is wound, and including means disposed between the fusing means and the take-up reel for twisting the metallic member 90° about its longitudinal axis.

7. Apparatus for applying an insulating coating on an elongated, continuously moving, metallic member, comprising:

a coating chamber, a gas permeable insulting member disposed in said coating chamber, a bed of finely divided, heat fusible particles of electrical insulating material disposed on said gas permeable insulating member, gas permeable electrode means spaced below said gas permeable insulating member, an electrical power supply connected to said electrode means, means directing a gas upwardly through said gas permeable electrode means and through said gas permeable insulating member to provide a cloud of electrostatically charged particles above said bed, said coating chamber including inlet and outlet apertures through which the metallic member passes, with the inlet and outlet apertures being located to direct the metallic member through said cloud, and a diffuser member disposed between said gas permeable electrode means and said gas permeable insulating member such that the gas strikes said diffuser member as it leaves said gas permeable electrode means, said diffuser member having a plurality of openings disposed therethrough which direct a predetermined portion of the gas through the diffuser member while deflecting the remaining portion of the gas about the outer edges thereof.

8. The apparatus of claim 7 wherein the openings in the diffuser member allow about 10% of the air directed against the diffuser member to pass therethrough.

9. The apparatus of claim 7 wherein the metallic member has a substantially rectangular cross-sectional configuration and is oriented in the cloud of insulating particles with two of its sides parallel to the bed of particles, and including means grounding the metallic member to cause electrostatically charged particles in the cloud to adhere to and deposit on the metallic member, and including baffle means disposed in the cloud about the metallic member to cause the particles to deposit uniformly on all sides of the metallic member.

10. Apparatus for applying an insulating coating on an elongated, continuously moving, metallic member having a substantially rectangular cross-sectional configuration, with one of the rectangular cross-sectional dimensions of the metallic member being smaller than the other dimension, comprising:

a coating chamber, a gas permeable insulating member disposed in said coating chamber, a bed of finely divided, heat fusible particles of electrical insulating material disposed on said gas permeable insulating member, gas permeable electrode means spaced below said gas permeable insulating member, an electrical power supply connected to said electrode means, means directing a gas upwardly through said gas permeable electrode means and through said gas permeable insulating member to provide a cloud of electrostatically charged particles above said bed, said coating chamber including inlet and outlet apertures through which the metallic member passes, with the inlet and outlet apertures being located to direct the metallic member through said cloud, said metallic member being oriented in the cloud of insulating particles with two of its sides parallel to the bed of particles, and including means orienting the metallic member in the cloud of insulating particles such that its sides parallel to the bed of particles are associated with the small cross-sectional dimension, means grounding the metallic member to cause electrostatically charged particles in the cloud to adhere to and deposit on the metallic member, a diffuser member disposed between said gas permeable electrode means and said gas permeable insulating member such that the gas strikes said diffuser member as it leaves said gas permeable electrode means, said diffuser member having a plurality of openings disposed therethrough which direct a predetermined portion of the gas through the diffuser member while deflecting the remaining portion of the gas about the outer edges thereof, and including baffle means disposed in the cloud about the metallic member to cause the particles to deposit uniformly on all sides of the metallic member, said baffle means including a first baffle member disposed between the metallic member and the bed of particles.

11. Apparatus for applying an insulating coating on an elongated, continuously moving, metallic member having a substantially rectangular cross-sectional configuration, comprising:

a coating chamber, a gas permeable insulating member disposed in said coating chamber, a bed of finely divided, heat fusible particles of electrical insulating material disposed on said gas permeable insulating member, gas permeable electrode means spaced below said gas permeable insulating member, an electrical power supply connected to said electrode means, means directing a gas upwardly through said gas permeable electrode means and through said gas permeable insulating member to provide a cloud of electrostatically charged particles above said bed, said coating chamber including inlet and outlet apertures through which the metallic member passes, with the inlet and outlet apertures being located to direct the metallic member through said cloud, said metallic member being oriented in the cloud of insulating particles with two of its sides parallel to the bed of particles, means grounding the metallic member to cause electrostatically charged particles in the cloud to adhere to and deposit on the metallic member, a diffuser member disposed between said gas permeable electrode means and said gas permeable insulating member such that the gas strikes said diffuser member as it leaves said gas permeable electrode means, said diffuser member having a plurality of openings disposed therethrough which direct a predetermined portion of the gas through the diffuser member while deflecting the remaining portion of the gas about the outer edges thereof, and baffle means disposed in the cloud about the metallic member to cause the particles to deposit uniformly on all sides of the metallic member, said baffle means including first, second and third baffle means, with the first baffle member being disposed between the metallic member and the bed of particles, and with the second and third baffle members being disposed on opposite sides of the metallic member and oriented to deflect the cloud of particles from a substantially vertical orientation towards and above the upper surface of the rectangular configuration of the metallic member.

12. Apparatus for applying an insulating coating on an elongated, continuously moving metallic member, comprising:

first means providing a liquid bath which chemically etches the metal of which the metallic member is formed, and means for inducing ultrasonic vibrations in said liquid bath, second means providing a free flowing water rinse, including a tubular member which defines an opening having first and second ends, and means directing water flow through the tubular member from the second to the first end, third means providing a water bath, and means for inducing ultra-sonic vibrations in said water bath, fourth means for electrostatically depositing finely divided, heat fusible particles of electrical insulating material on the metallic member, fifth means for fusing the particles deposited on the metallic member to provide a substantially uniform insulating coating on the metallic member, and sixth means for continuously and successively moving the metallic member through said first, second, third, fourth and fifth means, with the metallic member advancing through the tubular member of the second means from its first to its second end.

13. The apparatus of claim 12 including means heating the liquid bath of the first means to a predetermined elevated temperature.

14. The apparatus of claim 12 including means heating the water of the third means to a predetermined elevated temperature.

15. The apparatus of claim 12 including means heating the liquid bath of the first means to a predetermined elevated temperature, and means heating the water of the third means to a predetermined elevated temperature.

16. The apparatus of claim 12 wherein the fifth means heats the metallic member and particles deposited thereon to a predetermined elevated temperature, and including seventh means following the fifth means for cooling the conductor and its insulating coating, said seventh means including a tubular member defining an opening having first and second ends, means introducing a flow of water through the tubular member from its second to its first end, and wherein the sixth means advances the metallic member through the tubular member from its first to its second end.

17. The apparatus of claim 12 wherein the sixth means includes pay-off means for receiving a reel upon which the metallic member to be coated is wound and take-up means for receiving a reel upon which the insulated metallic member is wound, with said pay-off means and take-up means cooperating to provide a predetermined constant tension in the metallic member extending between the pay-off means and take-up means.

* * * * *